United States Patent [19]

Kondo

[11] Patent Number: 4,787,763

[45] Date of Patent: Nov. 29, 1988

[54] PRINTING RIBBON POSITIONING APPARATUS AND METHOD OF OPERATION THEREOF

[75] Inventor: Shinji Kondo, Aichi, Japan

[73] Assignee: Brother Kogyo Kabushiki Kaisha, Aichi, Japan

[21] Appl. No.: 841,438

[22] Filed: Mar. 19, 1986

[30] Foreign Application Priority Data

Mar. 20, 1985 [JP] Japan ..... 60-57169

[51] Int. Cl.[4] ..... B41J 33/36; B41J 33/56

[52] U.S. Cl. ..... 400/213; 400/208; 400/212; 400/217; 400/225; 400/229; 400/232

[58] Field of Search ..... 400/208, 212, 213, 213.1, 400/216, 217, 225, 229, 232

[56] References Cited

U.S. PATENT DOCUMENTS

| | | | |
|---|---|---|---|
| 3,346,090 | 10/1967 | Goff, Jr. et al. | 400/232 X |
| 3,401,783 | 9/1968 | Norwood et al. | 400/232 |
| 4,236,839 | 12/1980 | Mueller | 400/216.1 |
| 4,247,210 | 1/1981 | Kacmarcik et al. | 400/208 X |
| 4,397,575 | 8/1983 | Aldrich | 400/208 |
| 4,543,002 | 9/1985 | Bittner et al. | 400/212 |
| 4,563,100 | 1/1986 | Hamamichi | 400/212 X |
| 4,606,661 | 8/1986 | Aldrich et al. | 400/232 X |
| 4,611,938 | 9/1986 | Rettke et al. | 400/232 X |

*Primary Examiner*—Ernest T. Wright, Jr.
*Attorney, Agent, or Firm*—Finnegan, Henderson, Farabow, Garrett, & Dunner

[57] ABSTRACT

A printing ribbon positioning apparatus and method of operation thereof advances a ribbon in connection with the printing of a character with one of a plurality of print rows across the width of the ribbon by an amount that takes into consideration the past advancement of the ribbon in connection with the last characters printed with each of the other rows of the ribbon and the widths of the character to be printed and the last character printed with the same print row of the ribbon as the character to be printed.

7 Claims, 6 Drawing Sheets

| $d_3$ \ $d_0$ | SMALL | MEDIUM | LARGE |
|---|---|---|---|
| SMALL | 9 | 11 | 12 |
| MEDIUM | 11 | 12 | 14 |
| LARGE | 12 | 14 | 15 |
| | MIN. DISTANCE BETWEEN ADJACENT CHARACTERS $S_0$ | | |

| $d_2$ | $d_1$ | MIN. RIBBON STEPPING AMOUNT $P_S$ |
|---|---|---|
| S | SMALL | 3 |
| M | | |
| S | MEDIUM | 4 |
| M | | |
| L | | |
| | S | |
| S | LARGE | 5 |
| M | | |
| L | | |

PRINTING RIBBON POSITIONING APPARATUS AND METHOD OF OPERATION THEREOF

FIELD OF THE INVENTION

This invention relates to a printing ribbon positioning apparatus and a method of operating the apparatus in an electronic typewriter or other printers such as output units of computers or the like.

BACKGROUND OF THE INVENTION

Electronic typewriters commonly use a printing ribbon that is wider than the combined height of several characters, and a ribbon lifting mechanism operates to lift the ribbon to the printing position in such a manner that the ribbon lifting amount is changed in two or three steps. In this way, a number of rows of characters or symbols can be printed with a ribbon of limited length. In a typewriter using such a multi-track type printing ribbon, the distance that the ribbon is stepped in the longitudinal direction is constant at all times and fails to take into consideration the actual widths of the characters just printed.

Accordingly, the ribbon stepping amount must be set so that even when the widest characters or symbols, for instance the under-line (—) are successively printed in a row on the ribbon, the print marks on the ribbon will not overlap each other. Therefore, since the ribbon is limited in length, the number of characters that may be printed before discarding a ribbon is unnecessarily decreased, and ribbon consumption is increased.

On the other hand, since the ribbon is in the form of a thin tape, when the ribbon is stepped while being wound, it is liable to be slackened. This makes it difficult to increase the ribbon stepping speed even though the print hammer or the carriage can be operated at a high speed. Therefore, if the ribbon stepping amount is large, then the printing speed of the typewriter is adversely affected. Accordingly, it has not been possible to increase the printing speed beyond certain limits set by the ribbon advance mechanism.

OBJECTS AND SUMMARY OF THE INVENTION

Accordingly, it is an object of the present invention to provide an improved apparatus for avoiding the slackening of a print ribbon during print operations.

Another object of the present invention is to provide a printing ribbon positioning apparatus and method of operation that make efficient use of a print ribbon.

A further object of the present invention is to provide a printing ribbon positioning apparatus that operates at a very high speed.

These and other objects are attained by a printing ribbon positioning apparatus for use with a printing apparatus in which a printing mechanism prints characters or symbols on a printing medium through a ribbon that includes a plurality of print rows spaced across the width thereof, that is confronted with the printing surface of the printing medium, and that is stepped in a longitudinal direction whenever a printing operation is carried out, the apparatus comprising a ribbon lifting mechanism for sequentially positioning the print rows of the ribbon to a printing position as a sequence of printing operations is carried out, ribbon stepping amount determining means for determining a ribbon stepping amount in a longitudinal direction associated with a character to be printed in accordance with the widths of a predetermined number of characters most recently printed and the width of the character to be printed, and a ribbon stepping mechanism for advancing the ribbon in the longitudinal direction thereof by the ribbon stepping amount.

BRIEF DESCRIPTION OF THE DRAWINGS

The manner by which the above objects, and other objects, features, and advantages of the present invention are attained will become fully apparent from the following detailed description when it is considered in view of the drawings, wherein:

FIG. 12 is a perspective view of an electronic typewriter incorporating the ribbon advance mechanism of the present invention.

DETAILED DESCRIPTION

Figures 1, 7, 8:
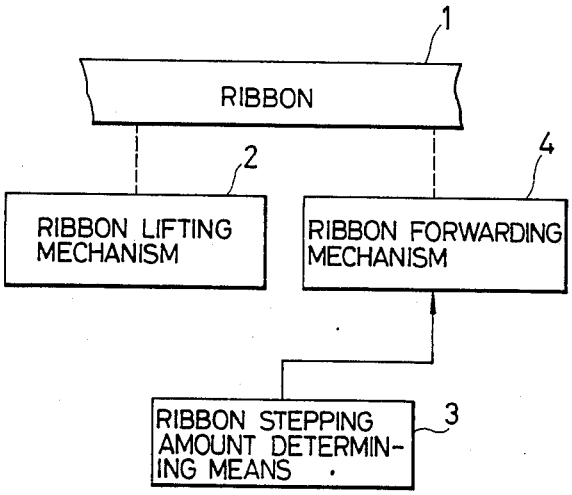
FIG. 1 is a schematic block diagram of a ribbon advance mechanism according to the present invention.
FIG. 7 is a data table for character distances.
FIG. 8 is a data table used when selecting minimum stepping amounts.

As shown in FIG. 1, a printing mechanism prints characters or symbols on a printing medium through a ribbon 1 that confronts the printing surface of the printing medium and is stepped in a longitudinal direction whenever a printing operation is carried out. A ribbon lifting mechanism 2 moves sequentially along the direction of the width of the ribbon 1 to a printing position as a printing operation is carried out. A ribbon stepping amount determining means 3 determines a ribbon stepping amount according to the sizes of the characters or symbols that were printed most recently and the size of a character or symbol to be printed next. A ribbon forwarding mechanism 4 steps the ribbon 1 lengthwise according to the ribbon stepping amount thus determined.

Figure 2:
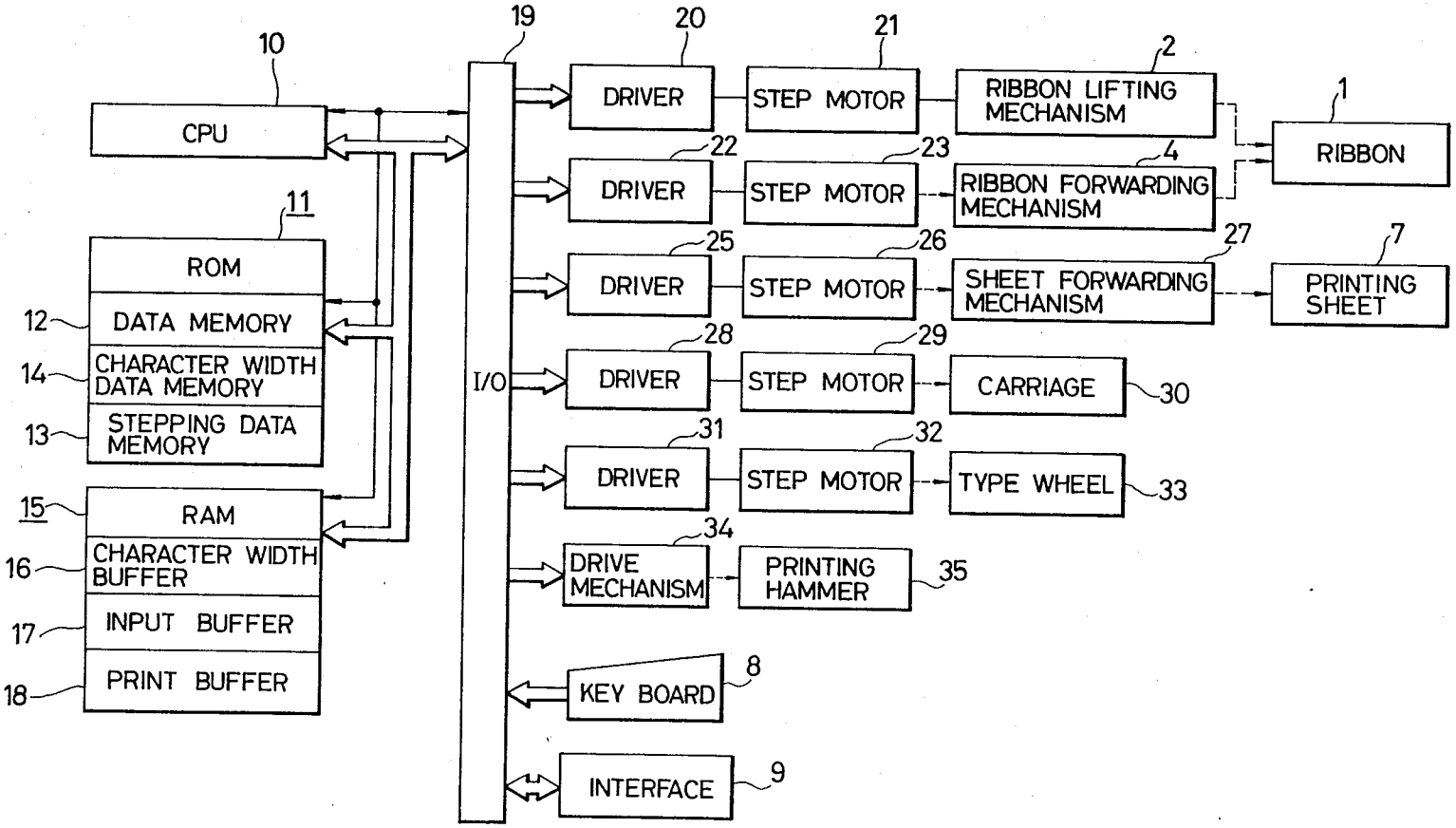
FIG. 2 is a schematic block diagram of an electronic printer for using the ribbon advance mechanism of the present invention.

FIG. 2 is a block diagram showing an electronic typewriter 60, shown in a perspective view in FIG. 12 in which a type wheel 33 having a number of printing elements **33*a* is provided. The keying operation of the keyboard 8 is electronically carried out with the aid of a CPU (central processing unit) 10, and the printing elements 33*a* corresponding to the keys 8*a* are struck by a printing hammer 35. The CPU 10 performs various operations necessary for controlling the typewriter 60 according to stored program data. A ROM 11 shown in FIG. 2** is adapted to store the program data, various constants, and table data.

The table data of the ROM 11 includes a data memory 12, a stepping data memory 13 and a character width data memory 14. The data memory 12 stores a correspondence table (FIG. 7) comprising the minimum distances $S_0$ required between adjacent characters on the ribbon 1. These distances $S_0$ change as the width $d_0$ of the next character to be printed and the width $d_3$ of the third to the last character printed vary between small, medium, and large. The stepping data memory 13 in the ROM 11 stores a correspondence table (FIG. 8) indicating the minimum ribbon stepping amount, $P_s$, for combinations of character width data $d_1$ of the character last printed and the character width data $d_2$ of the second to the last character printed where each character is classified into one of three grades, i.e., small, medium and large. The character width data memory 14 in the ROM 11 stores the width of the characters, symbols, marks, etc. on the keys 8*a* of the typewriter 60. These widths are also classified into one of three grades, i.e., small, medium, and large. Thus, for example, "$small_2$" indicates that the secoond to the last character printed was of a small grade.

A RAM 15 includes a character width buffer 16, an input buffer 17 and a print buffer 18. The character width buffer 16 temporarily stores the character widths $d_0$ through $d_3$ of the third to the last character printed. The content of the buffer 16 is continually updated upon advancement of a printing operation. The input buffer 17 stores data supplied through the keyboard 8 and an interface 9 from host equipment 64 such as external computers. The content of the input buffer 17 is continually renewed upon the receipt of new data. The print buffer 18 stores data relating to printing operations, including "a carriage return with a line feeding operation," "a line feeding operation," etc. The data stored in the print buffer 18 is also updated as printing operations are carried out.

The CPU 10 is connected to the keyboard 8, the interface 9, drivers 20, 22, 25, 28 and 31 (described later) and a drive mechanism 34, respectively, through an input/output port 19. The CPU 10, the ROM 11, the RAM 15 and the input/output port 19 are connected through a common bus 62, to form a ribbon stepping amount determining means 3 adapted to determined the amount of stepping, i.e., advance, of the print ribbon 1.

The electronic typewritter 60 uses a three-level type ribbon 1 and includes a ribbon lifting mechanism 2 to lift the ribbon 1 to confront the printing surface of a printing sheet 7 at a selected one of the three levels, or print rows, whenever a character is to be printed. A ribbon forwarding mechanism 4 advances the ribbon 1 by the stepping amount determined by the ribbon stepping amount determining means 3.

The ribbon lifting mechansim 2 is driven by a step motor 21 that is controlled by the driver 20. The ribbon forwarding mechanism 4 is driven by a step motor 23 that is controlled by the driver 22. A sheet forwarding mechansim 27 is driven by a step motor 26 that is controlled by the driver 25.

A carriage 30 holding a type wheel 33, a printing hammer 35, and a ribbon cassette 43 (FIG. 3) incorporating a ribbon 1 is driven in the direction of printing by a step motor 29 that is controlled by the driver 28. The type wheel 33 is driven by a step motor 32 that is controlled by the driver 31, in such a manner that a printing element 33*a* corresponding to a character, symbol, or mark to be printed reaches the printing position that confronts the printing hammer 35. The drive mechanism 34 employs an electromagnetic solenoid 66 (FIG. 2) to strike the printing hammer 35 against the printing element 33*a* that has been moved to the printing position.

In the electronic typewriter 60 described above, the CPU 10 carries out printing control according to the data inputted through the keyboard 8 or the interface 9, so that when the type wheel 33 is turned, the ribbon 1 is lifted and stepped, and the printing hammer 35 is driven to strike the type part of printing element 33*a* of the type wheel 33.

Figure 3:
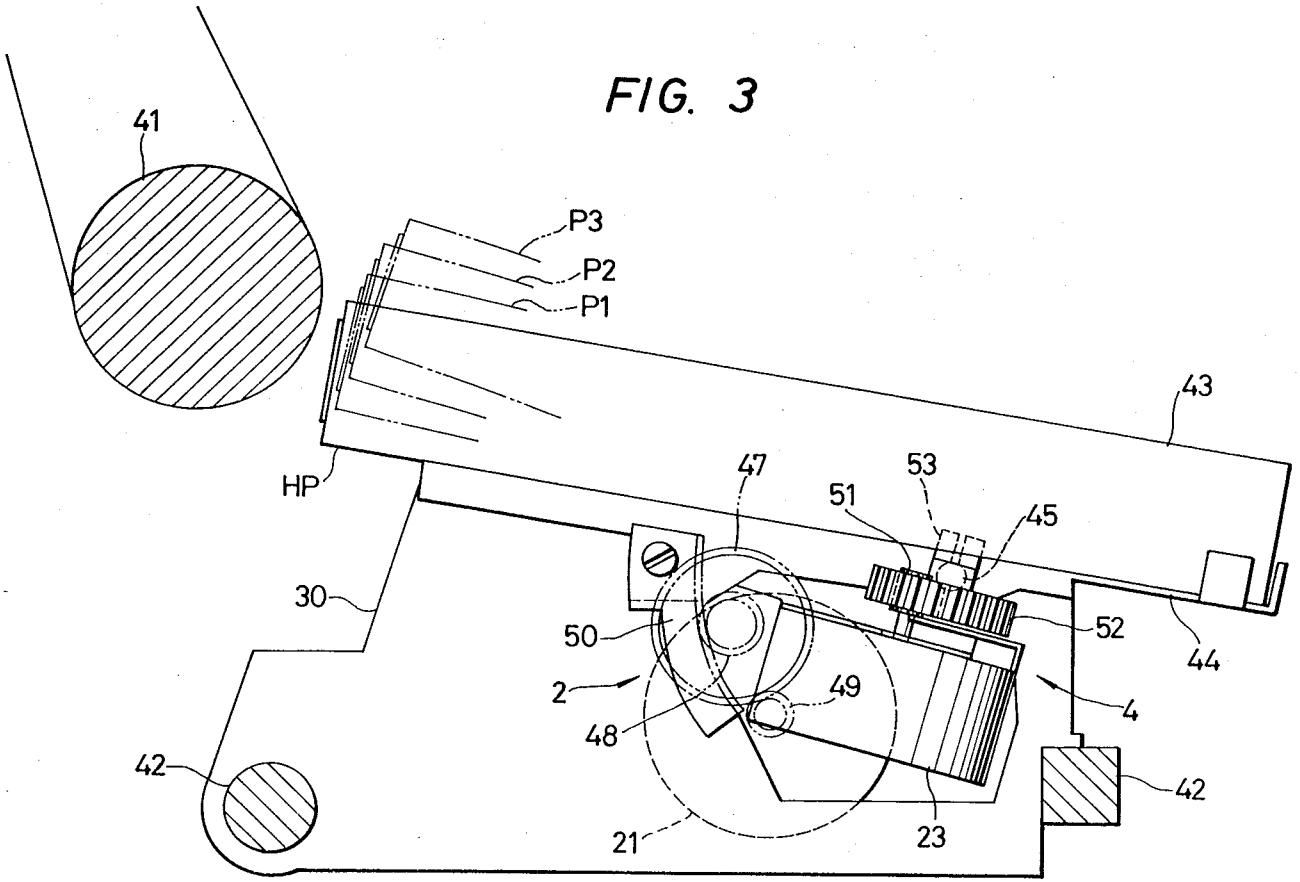
FIG. 3 is a sectional view of a ribbon lifting mechanism of the present invention.
Figure 4:
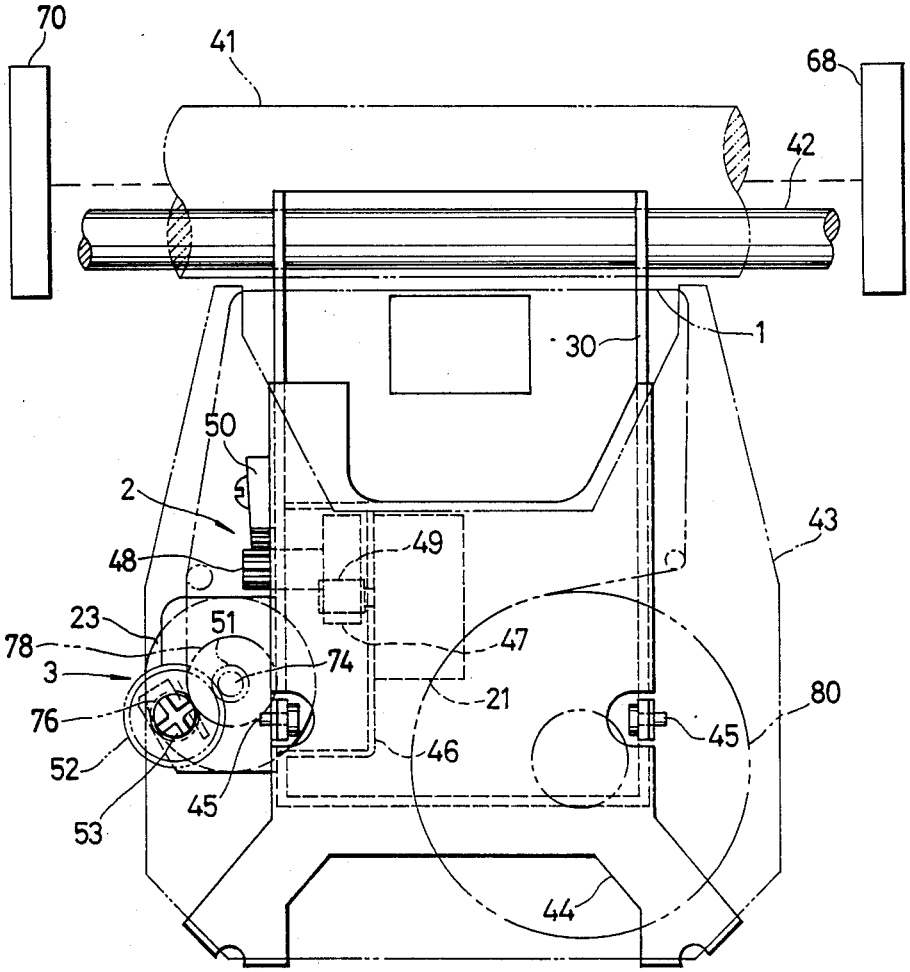
FIG. 4 is a plan view of a ribbon advance mechanism of the present invention.

FIGS. 3 and 4 show the ribbon lifting mechanism 2 and the ribbon forwarding mechanism 4. A platen 41 is rotatably supported between a right frame 68 and left frame 70. Two guide bars 42 and 42*a* are provided in parallel below the platen 41. The carriage 30 is slidably mounted on the guide bars 42, 42*a*. The ribbon cassette 43 accommodating the ribbon 1 is held by a holding member 44 that is provided on the carriage 30 in such a manner that the holding member 44 is rotatable through a predetermined arc about a pair of shafts 45. The step motor 21 for lifting the ribbon 1 is mounted on the carriage 30 with a mounting fixture 46. Intermediate gears 47 and 48 are provided on the carriage 30 in such a manner that they are coaxial with each other. The intermediate gear 47 is engaged with a drive gear 49 that is connected to the rotary shaft 72 of the step motor 21. The intermediate gear 48 is engaged with an arcuate rack 50 that is secured to the holding member 44 of the ribbon cassette 43. Therefore, as the step motor 21 rotates, the rack 50 is moved vertically through the drive gear 49 and the intermediate gears 47 and 48, whereby the holding member 44 secured to the rack 50 is swung about the shafts 45. In this manner, the ribbon cassette 43 held by the holding member 44 is moved in such a manner that the rear end thereof is lifted from its original position HP to a first, second, or third position $P_1$, $P_2$, or $P_3$, respectively, and returned to the original position HP.

The step motor 23 for the ribbon forwarding mechanism 4 is provided on the carriage 30. A small gear 51 is mounted on the output shaft 74 of the step motor 23. The small gear 51 is engaged with a large gear 52 of a drive shaft 53 that protrudes above the carriage 30 and is pivotally supported. The upper end portion of the drive shaft 53 is engaged with a roller 76 that abuts the ribbon 1 against a winding spool 78 of the ribbon cassette 43. As the step motor 23 rotates, the drive shaft 53 is rotated through the small gear 51 and the large gear 52 so that the ribbon 1 in the ribbon cassette 43 is wound on the winding spool 78 from a supply spool 80, i.e., it is advanced. The drive shaft 53 is engaged with the roller 76 of the ribbon cassette 43 in such a manner that the ribbon cassette 43 is rockable. Therefore, irrespective of the lift position of the ribbon cassette 43, the ribbon 1 is advanced by the distance determined by the ribbon stepping amount determining means 3 for every printing operation.

The operation of the electronic typewriter 60 will be described with reference to FIGS. 5 and 6 which are flow charts showing the operation of the CPU 10. The operations of the sheet forwarding mechanism 27, the carriage 30, the type wheel 33 and the printing hammer 35 will not be described here, because they are well known in the art. The ribbon control operation, which is one of the specific features of the present invention, will be described in detail.

First, in Step 100, it is determined whether or not a printing instruction has been issued, for instance, by operation of the keyboard 8. If no printing instruction is made, the operation of Step 100 is repeated. In the case where the printing instruction is issued, the amount of stepping $P_0$ of the ribbon 1 is then calculated in Step 200 according to a method as shown in FIG. 6. That is, in Step 210, the character width $d_0$ (large, medium, and small) of a character to be printed and the character width $d_3$ of the third to the last character printed are utilized in order to retrieve the minimum distance $S_0$ from the data table of FIG. 7, which is stored in the data memory 12. The minimum distance $S_0$ is the minimum distance between the centers of adjacent characters marked on the ribbon 1. The minimun distance $S_0$ is indicated by the number of steps (9, 11, 12, 14, or 15) of the ribbon forwarding step motor 23 as shown in the table of FIG. 7.

For instance, in the case where the character width $d_3$ is large ($large_3$), and the character width $d_0$ of the character to be printed is also large ($large_0$), then "15" is determined as the minimum distance $S_0$ separating the centers of adjacent characters to be printed without overlapping each other. Next, in Step 220, a fundamental amount of stepping $P_t$ is calculated according to the following expression:

$$P_t = S_0 - (P_1 + P_2)$$

where $P_1$ is the ribbon stepping amount calculated when the last character was printed and $P_2$ is the ribbon stepping amount which was calculated when the second to the last character was printed.

In the case where the last four characters, $d_3$, $d_2$, $d_1$ and $d_0$, that were printed were $large_3$, $small_2$, $small_1$, and $large_0$, respectively, the amount of stepping $P_1$ for $small_1$ is "4," and the amount of stepping $P_2$ for $small_2$ is "5,", and, therefore, the fundamental stepping amount $P_t$ is 6 ($=15-(4+5)$). This fundamental stepping amount $P_t$ is the minimum stepping value required to prevent the current character to be printed from overlapping on the ribbon 1 the third from the last character printed.

Next, in Step 230, the character width $d_1$ of a character printed immediately before the current character is determined to be large, medium or small by the referring to the character width buffer 16. If the character width $d_1$ is large, in Step 250 the minimum stepping amount $P_s$ is set to "5". If the character width $d_1$ is medium, the minimum stepping amount $P_s$ is set to "4" in Step 252. On the other hand, if the character width $d_1$ is small, and if in Step 240 the character width $d_2$ is determined to be larger than $P_s$ is set to "4" in Step 252. If $d_1$ is small, and the width $d_2$ is medium or small, in Step 254 the minimum stepping amount $P_s$ is set to "3". These values are obtained by retreiving the data table of FIG. 8 which is stored in the stepping data memory 13 of the ROM 11.

Next, in Step 260, it is determined whether or not the fundamental stepping amount $P_t$ is equal to or larger than the minimum stepping amount $P_s$. If $P_t$ is equal to or larger than $P_s$, then in Step 270 processing is so performed that the fundamental stepping amount $P_t$ is employed as a ribbon stepping about $P_0$ for the current printing operation. If $P_t$ is smaller than $P_s$, in Step 280 processing is carried out so that the minimum stepping amount $P_s$ is employed as the ribbon stepping amount $P_0$.

Figure 9:
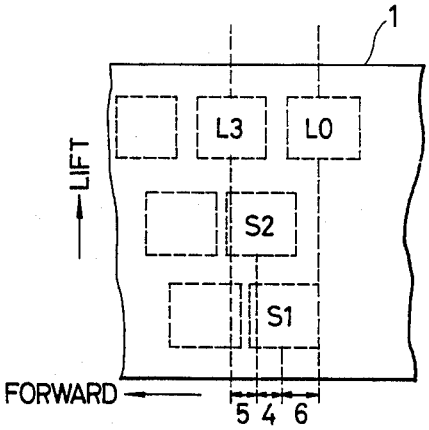
FIG. 9 is an explanatory view of print marks on a printing ribbon used in the present invention.

Accordingly, in the case where, as shown in FIG. 8, the character width $d_1$ of the last character printed is small, and the character width $d_2$ of the second to the last character printed is small or medium, the minimum stepping amount $P_s$ is "3". If after the fundamental stepping amount $P_t$ calculated in Step 220 is "6", in the case where as shown in FIG. 9, a series of characters having character widths $d_3$, $d_2$ and $d_1$ that are large, small, and small, respectively, have been printed, and then a character of large width is to be printed, the ribbon stepping amount $P_0$ is set to "6".

Figure 5:
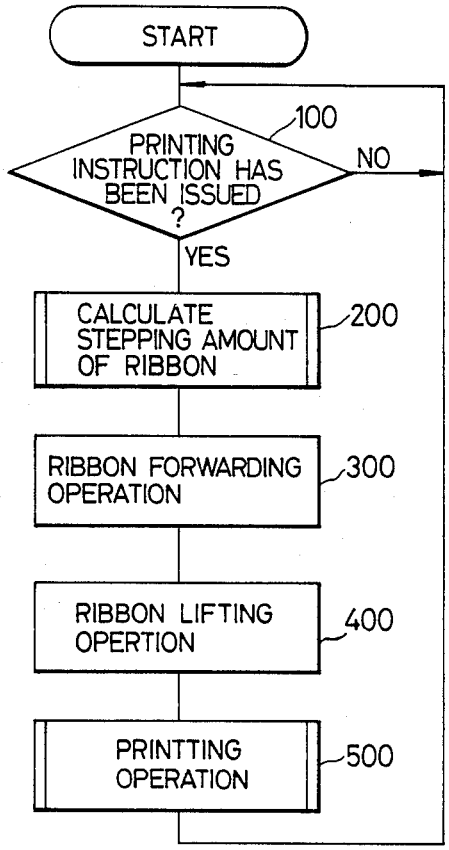
FIG. 5 is an operational flow chart of an electronic typewriter.
Figure 6:
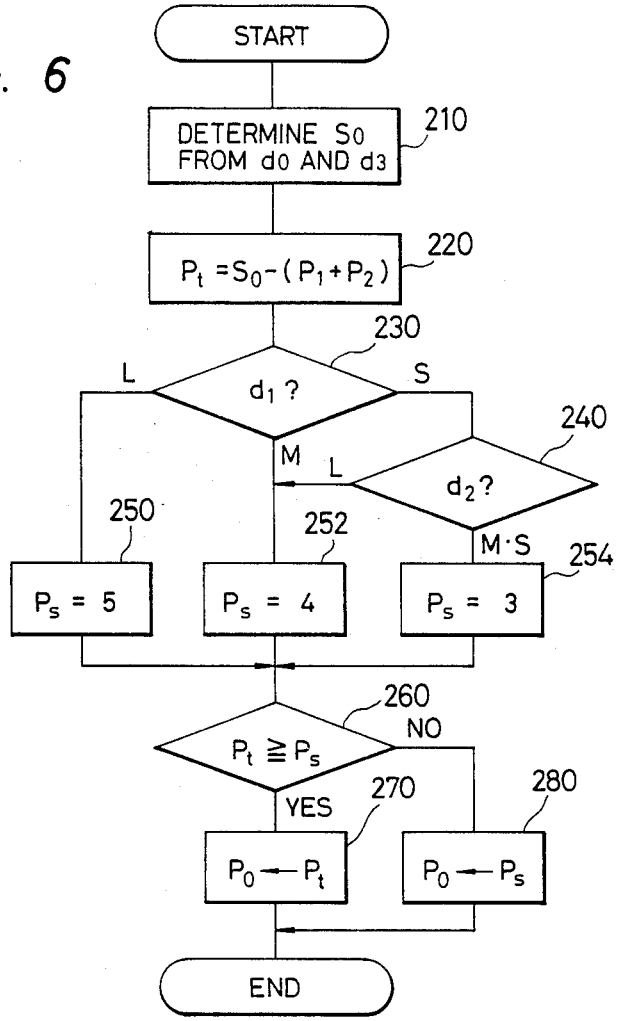
FIG. 6 is a flow chart of the steps involved in the calculation of a ribbon stepping amount in the present invention.

In Step 300 of FIG. 5, a control signal corresponding to the ribbon stepping amount $P_0$ thus calculated is applied through the input/output port 19 to the driver 22. As a result, the step motor 23 is driven by the driver 22, to rotate the drive shaft 53 of the ribbon forwarding mechanism 4 through an angle corresponding to the ribbon stepping amount $P_0$, so that the ribbon 1 is advanced by an amount equal to the ribbon stepping amount $P_0$.

In step 400, a control signal for lifting the ribbon 1 is applied through the input/output port 19 to the driver 20, so that the step motor 21 is driven by the driver 20. Accordingly, the holding member 44 of the ribbon cassette 43 rotates the ribbon cassette 43 about the shafts 45 to the first lift position $P_1$ (FIG. 3) so that the first level of the ribbon 1 reaches the printing position. Next, in Step 500, the print hammer 35 strikes the specified type part of the type wheel 33 so that the specified character or symbol is printed on the printing sheet 7. Thereafter, again in Step 100, it is determined whether or not a printing instruction has been issued. If a printing instruction has been issued, the above-described operations are carried out again.

As was described above, in the present invention, the character width $d_0$ of the next character to be printed and the character width $d_3$ of the third from the last character printed are marked beside each other on the ribbon 1, and the ribbon stepping amounts $P_1$ and $P_2$ are utilized to calculate a fundamental stepping amount $P_t$ for printing the current character so that the two character marks do not overlap on the ribbon 1. Furthermore, the character width $d_1$ of the last character printed and the character width $d_2$ of the second to the last character printed are utilized to obtain the minimum stepping amount $P_s$. The minimum stepping amount $P_s$ is compared with the fundamental stepping amount $P_t$, so that the larger is employed as the ribbon stepping amount $P_0$. Therefore, the ribbon 1 will never slacken, and it will not be moved forwarded excessively at one time. That is, the printing operation can be performed with the use of a minimum amount of ribbon 1, i.e., the most economical use of the ribbon 1 is made.

Figure 10:
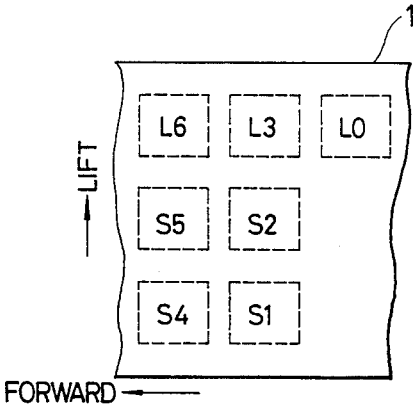
FIGS. 10 and 11 are explanatory diagrams showing patterns of print marks on a ribbon when a conventional ribbon positioning mechanism is used.

In order to clarify the effect provided by the use of the minimum stepping amount $P_s$, the case where only the fundamental stepping amount $P_t$ is utilized to determine the ribbon stepping amount will be described. It is assumed that, as shown in FIG. 10, the character widths $d_6$ through $d_1$ of the characters or symbols that have been printed are large, small, small, large, small, and small, respectively.

Between the print mark of the character of character width $d_6$ and the print mark of the character of character width $d_3$, the ribbon stepping amount $S_0$ is set to "15" according to the data shown in FIG. 7. In order that the print marks of character widths $d_5$ and $d_2$, which are both small do not overlap and the print marks of character widths $d_4$ and $d_1$ do not overlap, the necessary ribbon stepping amount is "9" in total according to the data of FIG. 7. Accordingly, when $d_2$ (small) is printed after $d_3$ (large) and when $d_1$ (small) is printed after $d_2$ (small), a ribbon stepping has already occurred which is sufficient to prevent adjacent characters from overlapping. Therefore, the ribbon 1 is not stepped and when the ribbon 1 is lifted, it will slacken as a result of vibration during operation, and the impact of the printing hammer 35.

Figure 11:
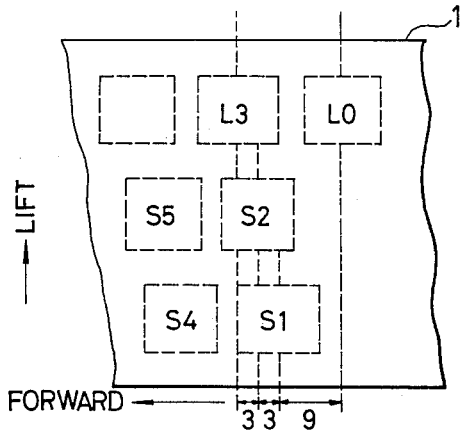

In order to prevent the ribbon 1 from slackening and to minimize the amount of use of the ribbon 1, the minimum stepping amount $P_s$ may be fixedly set to "3". However, for instance in the case where, as shown in FIG. 11, a series of characters having character widths $d_5$ through $d_1$ that are small, small, large, small, and small, respectively, in order to prevent the difficulty that the print "$large_3$" and "$large_0$" overlap each other, it is necessary to advance the ribbon 1 by nine (9) steps at one time. If it is necessary to advance the ribbon 1 greatly in one ribbon stepping operation as described above, then the time required for stepping the ribbon 1 will also increase with respect to the time required for driving the printing hammer 35, the sheet forwarding mechanism 27, the carriage 30 and the type wheel 33 in printing one character or symbol. The increase in the ribbon advancing time decreases the printing speed.

In order to overcome this difficulty, in the above-described embodiment, three minimum stepping amounts $P_s$ are employed. According to the character widths $d_1$ and $d_2$ of the first and second to the last characters printed, a minimum stepping amount $P_s$ is determined, and the minimum stepping amount $P_s$ and the fundamental stepping amount $P_t$ are utilized to determine a ribbon stepping amount. Accordingly, no matter what the character width is of a character or symbol to be printed, the ribbon stepping operation is carried out in printing each character or symbol. Therefore, the ribbon 1 will never be slackened by vibration in the ribbon lifting operation or by the printing-hammer striking operation. Furthermore, the ribbon stepping amount can be controlled according to the character width, and the ribbon stepping amounts can be allotted substantially uniformly to the ribbon stepping operations. Accordingly, consumption of the ribbon 1 can be reduced, and it is possible to eliminate the difficulty that the printing speed is descreased as the ribbon stepping amount is concentrated in one ribbon stepping operation.

As was described above, in the printing apparatus of the present invention, a ribbon stepping amount is determined from the sizes of the characters or symbols which were most recently printed. The number of such characters or symbols considered in determining the ribbon stepping amount is equal to the number of levels to which the ribbon 1 is lifted successively as printing operations are carried out. The ribbon stepping amount is determined according to the sizes of the characters or symbols that were recently printed and the size of the character or symbol to be printed next to avoid the overlap of print marks on the ribbon 1. Furthermore, the ribbon stepping operation is not concentrated to a particular printing operation; that is, the ribbon stepping amounts are relatively uniformly allotted to the printing operations. Therefore, in the printing apparatus of the present invention, unlike conventional devices in which the ribbon 1 is advanced by a predetermined length at all times, the ribbon advance amount is reduced when printing characters are small in size. Therefore, ribbon consumption is decreases as a whole so that the ribbon 1 is used more economically. Furthermore, the ribbon stepping amount is reduced as a whole, and the ribbon stepping amount is not concentrated in a particular printing operation. The time required for advancing the ribbon 1 is decreased, and higher printing rates can be achieved.

In the above-described embodiment, the ribbon 1 is lifted to three levels; however, it should be noted that the technical concept of the present invention is applicable to the case where the ribbon 1 is lifted to any number of levels greater than one level. In addition, the technical concept of the present invention is also applicable to the case where an erasing ribbon 82 (FIG. 2) is lifted to a plurality of levels. Furthermore, the technical concept of the present invention can be applied to a variety of printers employed as the output units of computers or the like as well as to the above-described electronic typewriter.

I claim:

1. A printing ribbon positioning apparatus for use with a printing apparatus in which a printing mechanism prints characters or symbols on a printing medium through a ribbon that includes a plurality of print rows spaced across the width thereof, that is confronted with the printing surface of the printing medium, and that is stepped in a longitudinal direction whenever a printing operation is carried out, the apparatus comprising:

a ribbon lifting mechanism for sequentially positioning the print rows of the ribbon to a printing position as a sequence of printing operations is carried out;

means for determining a ribbon stepping amount in the longiduinal direction associated with a character to be printed in accordance with the widths of a predetermined number of characters most recently printed and the width of said character to be printed; and a ribbon stepping mechanism for advancing the ribbon in the longitudinal direction thereof by said ribbon stepping amount.

2. A printing ribbon positioning apparatus according to claim 1, wherein said predetermined number of characters is equal to the number of print rows across the width of the ribbon.

3. A printing ribbon positioning apparatus according to claim 2, wherein said ribbon stepping amount determining means comprises:

first memory means for storing and selectively outputting a minimum distance for said character to be printed which depends on the width of said character to be printed and the width of the character most recently printed using the same print row of the ribbon as the print row to be used for printing said character to be printed;

second memory means for storing the widths of a number of characters most recently printed equal to said predetermined number; and means for computing said ribbon stepping amount as the difference between said minimum distance and the cumulative amount that the ribbon was stepped in the longitudinal direction in association with the printing of the last character with each print row of the ribbon other than the print row to be used in the printing of said character to be printed.

4. A printing ribbon positioning apparatus according to claim 2, wherein said ribbon stepping amount determining means comprises:

first memory means for storing and selectively outputting a minimum distance for said character to be printed which depends on the width of said character to be printed and the width of the character most recently printed using the same print row of the ribbon as the print row to be used for printing said character to be printed;

second memory means for storing the widths of a number of characters most recently printed equal to said predetermined number;

third memory means for storing the distance the ribbon was advanced in the longitudinal direction during the printing of a number of the most recently printed characters equal to said predetermined number; and means coupled to said first, second, and third memory means for computing a fundamental stepping amount equal to the difference between said minimum distance and the sum of said distances the print ribbon was advanced in association with the printing of the most recent character with each print row of the ribbon other than the print row to be used in printing said character to be printed, for determining a minimum stepping amount in accordance with the widths of the characters most recently printed with a print row of the ribbon other than the print row of the ribbon to be used in the printing of said character to be printed, and for setting said ribbon setting amount to (1) said fundamental stepping amount if said fundamental stepping amount is greater than or equal to said minimum stepping amount, or (2) said minimum stepping amount if said fundamental stepping amount is less than said minimum stepping amount.

5. A printing ribbon positioning apparatus according to claim 4, wherein said computing, determining, and setting means comprises a central processing unit.

6. A method for determining the minimum stepping amount of a printing ribbon in the longitudinal direction in connection with the printing of a character by a printing apparatus that includes a printing ribbon positioning apparatus for a printing ribbon including a plurality of print rows spaced across the width of the ribbon, the method comprising the steps of:

determining a minimum distance for the ribbon associated with the printing of the character to be printed;

computing a fundamental stepping amount equal to the difference between said minimum distance and the sum of the distances that the print ribbon was advanced in association with the printing of the most recent character with a print row of the printing ribbon other than the print row to be used in the printing of the character to be printed; and setting the ribbon stepping amount to (1) the fundamental stepping amount if the fundamental stepping amount is greater than or equal to the minimum stepping amount, or (2) the minimum stepping amount if the fundamental stepping amount is less than the minimum stepping amount.

7. An apparatus for determining the ribbon stepping amount of a printing ribbon in the longitudinal direction in connection with the printing of a character by a printing apparatus that includes a printing ribbon positioning apparatus for a printing ribbon including a plurality of print rows spaced across the width of the ribbon, the determining apparatus comprising:

memory means for storing (1) a plurality of minimum distances, each of said minimum distances corresponding to a different combination of character widths for the character to be printed and the character most recently printed using the same print row of the ribbon as the print row to be used for printing the character to be printed, (2) the widths of a predetermined number of characters most recently printed, said predetermined number being equal to the number of print rows across the width of the printing ribbon, and (3) the distance the ribbon was advanced in the longitudinal direction during the printing of the most recently printed with a print row other than the print row to be used with the character to be printed; and means coupled to said memory means for selecting a minimum distance from said memory means in accordance with the character to be printed and the last character printed using the print row of the ribbon to be used in printing the character to be printed, for computing a fundamental stepping amount equal to the difference between said minimum distance and the sum of said distances the print ribbon was advanced in association with the printing of the most recent character with each print row of the ribbon other than the print row to be used in printing said character to be printed, for determining a minimum stepping amount in accordance with the widths of the characters most recently printed with a print row of the ribbon other than the print row of the ribbon to be used in the printing of said character to be printed, and for setting said ribbon stepping amount to (1) said fundamental stepping amount if said fundamental stepping amount is greater than or equal to said minimum stepping amount, or (2) said minimum stepping amount if said fundamental stepping amount is less than said minimum stepping amount.

* * * * *